US008726713B2

(12) United States Patent
Steiner et al.

(10) Patent No.: US 8,726,713 B2
(45) Date of Patent: May 20, 2014

(54) CRIMPING TOOL

(71) Applicant: Rostra Tool Company, Branford, CT (US)

(72) Inventors: Richard A. Steiner, East Haddam, CT (US); Joseph Krzyzanski, New Haven, CT (US)

(73) Assignee: Rostra Tool Company, Branford, CT (US)

( * ) Notice: Subject to any disclaimer, the term of this patent is extended or adjusted under 35 U.S.C. 154(b) by 0 days.

(21) Appl. No.: 14/060,642

(22) Filed: Oct. 23, 2013

(65) Prior Publication Data

US 2014/0096360 A1 Apr. 10, 2014

Related U.S. Application Data

(63) Continuation of application No. 13/647,606, filed on Oct. 9, 2012, now Pat. No. 8,584,503.

(51) Int. Cl.
*B21D 37/10* (2006.01)

(52) U.S. Cl.
USPC ..... 72/416; 72/409.01; 72/453.16; 72/465.1; 29/237; 29/268

(58) Field of Classification Search
USPC ..... 72/409.01, 412, 415, 416, 453.16, 72/465.1; 29/237, 268, 522.1, 863, 29/890.149
See application file for complete search history.

(56) References Cited

U.S. PATENT DOCUMENTS

| | | | | | |
|---|---|---|---|---|---|
| 1,319,837 | A | * | 10/1919 | Brinkman | 72/416 |
| 2,244,482 | A | | 6/1941 | Baxter et al. | |
| 2,327,650 | A | | 8/1943 | Klein | |
| 2,382,292 | A | | 8/1945 | Carlson | |
| 2,411,838 | A | | 11/1946 | Swengel | |
| 2,618,993 | A | | 11/1952 | Carlson | |
| 2,635,494 | A | | 4/1953 | Rogoff | |
| 2,994,238 | A | | 8/1961 | Matthysse | |
| 3,010,183 | A | * | 11/1961 | Forney, Jr. | 29/863 |
| 3,039,337 | A | | 6/1962 | Stuart-Prince | |
| 3,051,773 | A | * | 8/1962 | Batcheller | 29/522.1 |
| 3,084,575 | A | | 4/1963 | Klein | |
| 3,181,341 | A | | 5/1965 | Thornton, et al. | |
| D201,915 | S | | 8/1965 | Werner | |
| 3,330,148 | A | | 7/1967 | Hornung | |
| 3,410,129 | A | | 11/1968 | Werner | |
| 3,417,599 | A | * | 12/1968 | Burns | 72/409.08 |
| 3,869,776 | A | * | 3/1975 | Moshnin et al. | 29/890.149 |
| 3,872,528 | A | | 3/1975 | Porter | |
| 4,144,737 | A | | 3/1979 | Izraeli | |
| 4,170,154 | A | | 10/1979 | Izraeli | |
| 4,561,282 | A | * | 12/1985 | Hadden, Sr. | 72/416 |
| 5,042,285 | A | | 8/1991 | Levy | |

(Continued)

*Primary Examiner* — David B Jones
(74) *Attorney, Agent, or Firm* — Cantor Colburn LLP

(57) ABSTRACT

A crimping tool is provided for coupling a pipe with a connector or fitting. The crimping tool includes a first jaw having an opening on one side. The opening has a first slot sized and shaped to receive a portion of a pipe connector. A second jaw is operably coupled to the first jaw, the second jaw having a semi-cylindrical surface on one side with a second slot disposed therein. The semi-cylindrical surface sized and shaped to receive a portion of the pipe connector. The first jaw and second jaw are moveable between a first position and a second position, the semi-cylindrical surface being arranged at least partially within the opening when in the closed position.

17 Claims, 4 Drawing Sheets

(56) References Cited

U.S. PATENT DOCUMENTS

| | | | | |
|---|---|---|---|---|
| 5,490,406 | A * | 2/1996 | College | 72/412 |
| 5,722,284 | A | 3/1998 | Linsmeyer | |
| 6,128,943 | A | 10/2000 | Lemmens | |
| 6,739,172 | B2 | 5/2004 | Wagner | |
| 7,000,448 | B2 | 2/2006 | Hamm et al. | |
| D532,672 | S | 11/2006 | Steiner | |
| 7,409,847 | B2 * | 8/2008 | Wightman et al. | 72/416 |
| 7,434,440 | B2 | 10/2008 | Fay | |
| 7,628,052 | B2 | 12/2009 | Zhang | |
| 2002/0092336 | A1 | 7/2002 | Wagner | |
| 2008/0078273 | A1 | 4/2008 | Steiner et al. | |

* cited by examiner

CRIMPING TOOL

BACKGROUND OF THE INVENTION

The subject matter disclosed herein relates to a crimping tool and in particular to a crimping tool having an interrupted crimp profile.

Crimping tools are used in applications, such as in heating, ventilation and air-conditioning applications for example, in order to connect two pipes or pipe sections to one another by means of connecting members, commonly referred to as "fittings". The connecting members are slipped over the ends of two pipes and are then plastically deformed in order to couple the two pipes together. The crimping tool has two pressing jaws that each contain an opening sized to fit about a portion of the pipe. In order to actuate the pressing jaws and exert the pressing force, the crimping tool includes a pair of elongated arms that provide the mechanical advantage needed to achieve the desired connection.

While existing crimping tools are suitable for their intended purpose the need for improvement remains, particularly in providing a crimping tool that improves the reliability of the crimped joint.

BRIEF DESCRIPTION OF THE INVENTION

According to one aspect of the invention, a crimping tool is provided for coupling a pipe with a connector or fitting. The crimping tool includes a first jaw having an opening on one side. The opening has a first slot sized and shaped to receive a portion of a pipe connector. A second jaw is operably coupled to the first jaw, the second jaw having a semi-cylindrical surface on one side with a second slot disposed therein. The semi-cylindrical surface sized and shaped to receive a portion of the pipe connector. The first jaw and second jaw are moveable between a first position and a second position, the semi-cylindrical surface being arranged at least partially within the opening when in the closed position.

According to another aspect of the invention, another crimping tool for coupling a pipe to a connector is provided. The crimping tool includes a first arm. A second arm is arranged adjacent and operably coupled to the first arm. A first jaw is pivotally coupled to the first arm, the first jaw having an opening on a side adjacent the second arm, the opening having a first semi-circular slot therein. A second jaw is pivotally coupled to the second arm opposite the first jaw, the second jaw having a semi-circular first surface adjacent the opening with a second semi-circular slot therein, wherein the first jaw and second jaw are movable between an open and closed position, the semi-cylindrical surface being disposed within the opening when in the closed position.

According to yet another aspect of the invention, another crimping tool is provided for coupling a pipe to a pipe connector. The crimping tool includes a first arm and a second arm operably coupled to the first arm. A first jaw is pivotally coupled to the first arm, the first jaw having an opening between a first surface and a second surface on a first side, the opening having a pair of semi-cylindrical first surfaces separated by a first slot. A second jaw is pivotally coupled to the second arm, the second jaw having a pair of semi-cylindrical second surfaces adjacent the opening, the pair of semi-cylindrical second surfaces being separated by a second slot. Wherein the first jaw and second jaw are movable between an open and closed position in response to movement of the first arm and second arm.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Embodiments of the present invention provide for a crimping tool that may be used to couple a pipe to a connector or a fitting, such as those used in heating, ventilation and air-conditioning (HVAC) applications. Embodiments of the invention provide advantages in improving the reliability and increasing the pull out force of the crimp connection formed between the pipe and the connector or fitting.

Figure 1:
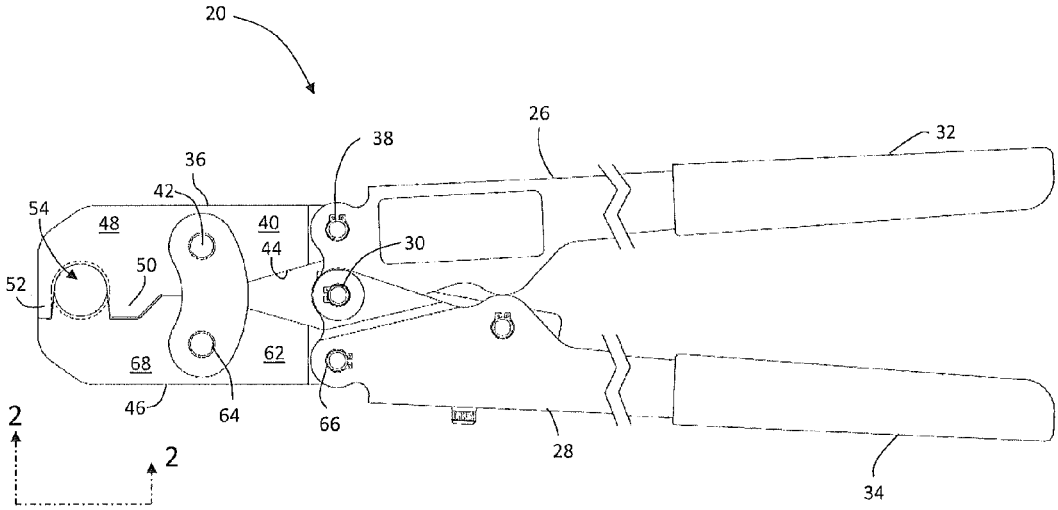
FIG. 1 is a top view of a crimping tool in accordance with an embodiment of the invention.
Figure 2:
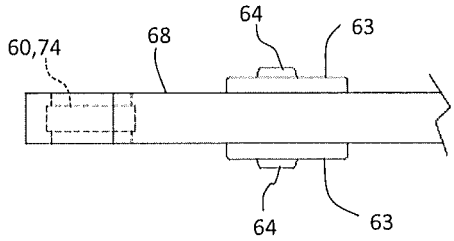
FIG. 2 is a partial side view of the crimping tool of FIG. 1.
Figure 3:
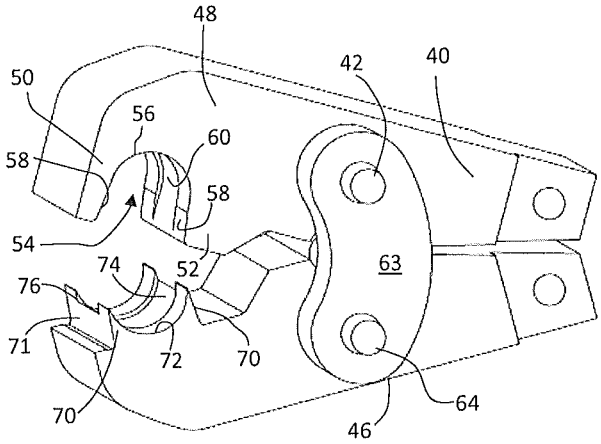
FIG. 3 is a partial perspective view of the jaws used with the crimp ring tool of FIG. 1.
Figure 4:
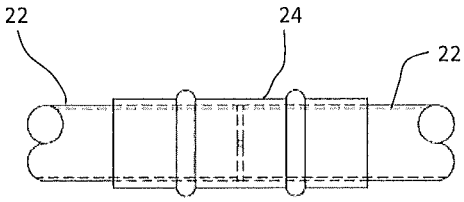
PRIOR ART FIG. 4
FIG. 4 is a side view of a prior art uncrimped pipe and connector assembly; and, FIG. 5 is a side view of the pipe and connector assembly of FIG. 4 which is coupled together using the crimping tool of FIG. 1.

A crimping tool 20 is shown in FIGS. 1-3 for coupling a pipe 22 to a connector 24 (FIG. 4). The crimping tool 20 includes a pair of arms 26, 28 that are connected by a pivot 30. On one end of the arms 26, 28 may include grips 32, 34 for the operator to hold during operation. The arms 26, 28 may be made any suitable material, such as steel for example, that is capable of operating under the loads used to crimp a pipe 22 to a connector 24.

Coupled to the first arm 26 is a first jaw member 36. The jaw member 36 is coupled to the first arm 26 by a pivot 38. The first jaw member 36 includes an arm 40 arranged between a bracket pivot 42 and the pivot 38. The arm 40 has an angled surface 44 arranged on a side adjacent the arm 28. The angled surface 44 provides a relief that allows the first jaw member 36 to rotate relative to the second jaw member 46 without interference during operation. The first jaw member 36 further has a body portion 48 arranged opposite the arm 40 from pivot 42. The body portion 48 includes a first projection 50 and a second projection 52 arranged on opposite sides of an opening 54.

The opening 54 includes a semi-cylindrical section 56 and a pair of opposing angled surfaces 58 adjacent an open side of the opening 54. The surface of the semi-cylindrical section 56 is bifurcated by a slot 60 to form a pair of semi-cylindrical surfaces separated by the width of the slot 60. In the exemplary embodiment, the slot 60 is 0.25 inches (6.35 millimeters) wide and has a diameter that is larger than the outer diameter of the pipe connector 24. As will be discussed in more detail below, in one embodiment, the width of each of the pair of semi-cylindrical surfaces of semi-cylindrical section 56 is one-half the width of the slot 60. In one embodiment, the slot 60 extends past the end of the semi-cylindrical portion and at least partially extends along both of the angled surfaces 58. The opening 54 is sized to receive at least a portion of a fitting or pipe connector 24.

The second jaw member 46 is coupled to the second arm 28 by a pivot 66. A bracket 63 couples the first jaw member 36 and second jaw member 46 via pivots 42, 64 such that jaw members 36, 46 rotate about the pivots in opposite directions during operation. The second jaw member 46 also includes an arm portion 62 arranged between the bracket pivot 64 and the pivot 66.

The second jaw member 46 further includes a body portion 68 is arranged opposite the arm portion 62. The body portion 68 includes a recess 69 that is sized and positioned to receive the projection 52 without interference when the jaws 36, 46 are moved to a closed position. A pair of projections 70 extends from a side of the second jaw member 46 adjacent the first jaw member 36. A semi-cylindrical surface 72 is formed between the projections 70. A slot 74 bifurcates the semi-cylindrical surface 72 to form a pair of semi-cylindrical surfaces separated by the width of the slot 74. In one embodiment, the slot 74 extends to the end of the projections 70 to form a u-shaped opening 76 at the end of the projections 70. In the exemplary embodiment, the slot 74 is 0.25 inches (6.35 millimeters) wide and has a diameter that is larger than the outer diameter of the pipe connector 24. As will be discussed in more detail below, in one embodiment, the width of each of the pair of semi-cylindrical surfaces of semi-cylindrical surface 72 is one-half the width of the slot 74. The slot 74 may have the same diameter as the slot 60. In one embodiment, the outer surface 71 of the projections 70 is angled and sized to be received between the angled surfaces 58.

The semi-cylindrical surface is sized to receive at least a portion of a fitting or pipe connector 24. In one embodiment, the surfaces 56, 72 are the same diameter and configured to form a substantially contiguous round opening. As will be discussed in more detail below, the projections 70 and semi-cylindrical surface 72 are arranged to cooperate with the opening 54 to engage a pipe connector 24 and form a pair of crimps that couples a pipe 22 to the pipe connector 24.

During operation, the operator initiates the crimping process by inserting at least one end of a pipe 22 into a pipe connector 24 as shown in FIG. 4. It should be appreciated that while the pipe connector 24 is shown as a straight butt connection, this is for exemplary purposes and the claimed invention should not be so limited. The fitting or pipe connector 24 may be any suitable fitting such as but not limited to an elbow fitting, a t-fitting, or a valve for example. The jaws 36, 46 of tool 20 are opened by moving the arms 26, 28 away from each other. Since the jaws 36, 46 rotate about the pivots 42, 64, the movement of the arms 26, 28 away from each other causes the jaws 36, 46 to open, which allows the pipe connector 24 to be inserted into the opening 54 and against the semi-cylindrical surface 56.

Figure 5:
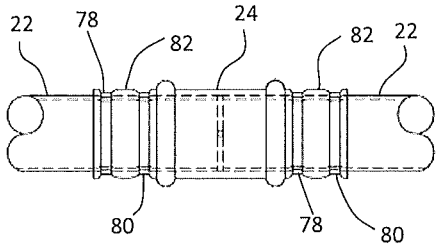

When the motion of the arms 26, 28 is reversed, the jaws 36, 46 will start to close such that the surface 72 engages the pipe connector 24 opposite the surface 56. By continued application of force to the arms 26, 28, the material of the pipe connector 24 and the pipe 22 will be deformed to form a pair of crimps 78, 80 as shown in FIG. 5. Since the diameter of the slots 60, 74 is larger than the outer diameter of the pipe connector 24 the area adjacent the slots 60, 74 allows the pipe 22 and connector 24 to expend into the area formed by the slots 60, 74. The expansion or bulging of the material into the slots 60, 74 provides advantages in increasing the pull out force (e.g. the axial force needed to separate the pipe from the connector). Thus, the crimps 78, 80 are separated by a distance equal to the width of the slots 60, 74. In the exemplary embodiment, the width or land of each crimp 78, 80 is one-half the width of the portion 82 (e.g. the area adjacent the slots 60, 72 during crimping) between the crimps 78, 80. It has been found that this provides advantages in balancing the pull out strength and cold working of the metal in the pipe and pipe connector during the crimp process. If the widths of crimp 78, 80 lands are increased, pull out strength is decreased. If the width of the crimp 78, 80 lands are decreased, the material strength of the metal decreases. The deformation of the pipe connector 24 and pipe 22 forms a crimp that connects and seals the pipe connector 24 and pipe together.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A crimping tool for coupling a connector to a pipe, the crimping tool comprising:

a first jaw having a opening on one side and having a first slot disposed therein, wherein the opening is sized and shaped to receive at least a portion of an end portion of the connector;

a second jaw operably coupled to the first jaw, the second jaw having a semi-cylindrical surface on one side with a second slot disposed therein, the semi-cylindrical surface being sized and shaped to receive an end portion of the connector;

wherein the first jaw and second jaw are moveable between an open position and a closed position, the semi-cylindrical surface being arranged at least partially within the opening when in the closed position, and the second slot is arranged opposite the first slot when the first jaw and second jaw are in the closed position.

2. The crimping tool of claim 1 wherein the first slot and second slot cooperate to form a substantially cylindrical slot when the first jaw and second jaw are in the closed position.

3. The crimping tool of claim 2 wherein the first jaw includes a first surface and an opposing second surface, the first slot being disposed between the first surface and second surface.

4. The crimping tool of claim 3 wherein the second slot bifurcates the semi-cylindrical surface.

5. The crimping tool of claim 3 wherein the first surface includes a pair of opposing surfaces on opposite sides of the first slot, the width of each of the pair of opposing surfaces being one-half the width of the first slot.

6. The crimping tool of claim 2 wherein the opening includes a semi-circular first portion and a tapered second portion, the semi-cylindrical surface being disposed within the second portion when in the closed position.

7. A crimping tool for coupling a pipe to a connector, the crimping tool comprising:

a first arm;

a second arm arranged adjacent and operably coupled to the first arm;

a first jaw pivotally coupled to the first arm, the first jaw having an opening on a side adjacent the second arm, the opening having a first semi-circular slot therein;

a second jaw pivotally coupled to the second arm opposite the first jaw, the second jaw having a semi-circular first surface adjacent the opening with a second semi-circular slot therein, wherein the first jaw and second jaw are movable between an open and closed position, the semi-cylindrical surface being disposed within the opening when in the closed position, wherein the first opening, the second opening, the first semi-circular slot and the second semi-circular slot cooperate to crimp the connector to the pipe when the first jaw and second jaw are in the closed position.

8. The crimping tool of claim 7 wherein the first semi-circular slot and the second semi-circular slot form a substantially contiguous first cylindrical surface when in the closed position.

9. The crimping tool of claim 8 wherein the first cylindrical surface has an inner diameter greater than the outer diameter of the pipe connector.

10. The crimping tool of claim 7 wherein the opening has a semi-cylindrical portion and a second portion between the semi-cylindrical portion and the side facing the second arm.

11. The crimping tool of claim 10 wherein semi-cylindrical portion and the first surface form a pair of substantially contiguous cylindrical surfaces when in the closed position.

12. The crimping tool of claim 11 wherein the pair of substantially contiguous cylindrical surfaces have an inner diameter that is less than the outer diameter of the pipe connector.

13. A method of crimping a connector to a pipe, the method comprising:

providing a crimping tool having a first jaw operably coupled to a second jaw, the first jaw having an opening on one side and having a first slot disposed therein, wherein the opening is sized and shaped to receive at least a portion of an end portion of the connector, the second jaw having a semi-cylindrical surface on one side with a second slot disposed therein, the semi-cylindrical surface being sized and shaped to receive an end portion of the connector;

placing the connector onto the pipe;

moving the first jaw and second jaw to an open position;

placing the connector into the opening adjacent an end of the connector;

moving the first jaw and second jaw to a closed position; and displacing material from the connector into the first slot and second slot when in the closed position to couple the connector to the pipe.

14. The method of claim 13 wherein the connector has at least one circumferential protrusion.

15. The method of claim 14 wherein the step of placing the connector into the opening includes placing a portion of the connector between the at least one circumferential protrusion and the end in the opening.

16. The method of claim 15 wherein the first slot and the second slot have an inner diameter that is larger than an outer diameter of the connector when in the closed position.

17. The method of claim 16 wherein the displaced material forms a substantially contiguous circumferential ring around the connector.

* * * * *